US007246393B2

(12) United States Patent
Westendorf et al.

(10) Patent No.: US 7,246,393 B2
(45) Date of Patent: Jul. 24, 2007

(54) INFLATABLE MATTRESS

(75) Inventors: David J Westendorf, Monroe, MI (US); Kevin J Knowles, Monroe, MI (US)

(73) Assignee: West & Knowles Design and Engineering, L.L.C., Monroe, MI (US)

( * ) Notice: Subject to any disclaimer, the term of this patent is extended or adjusted under 35 U.S.C. 154(b) by 17 days.

(21) Appl. No.: 11/103,388

(22) Filed: Apr. 11, 2005

(65) Prior Publication Data

US 2006/0225219 A1 Oct. 12, 2006

(51) Int. Cl.
*A47C 27/00* (2006.01)

(52) U.S. Cl. ..... 5/706; 5/710; 5/722; 5/12.1

(58) Field of Classification Search ..... 5/706, 5/710, 722, 12.1, 12.2, 14, 16, 46.1; 297/112
See application file for complete search history.

(56) References Cited

U.S. PATENT DOCUMENTS

| | | | | |
|---|---|---|---|---|
| 984,685 A | | 2/1911 | Luppino | |
| 1,244,821 A | | 10/1917 | Zaleski et al. | |
| 1,751,897 A | | 3/1930 | Thum | |
| 2,604,641 A | * | 7/1952 | Reed | 5/710 |
| 2,648,072 A | | 8/1953 | DeBlieux | |
| 3,166,799 A | | 1/1965 | Birnkrant | |
| 3,555,581 A | * | 1/1971 | Friant | 5/705 |
| 3,648,306 A | | 3/1972 | Auerbach | |
| 4,153,958 A | | 5/1979 | Paulik | |
| 4,169,295 A | | 10/1979 | Darling | |
| 4,442,556 A | | 4/1984 | Craigie | |
| 4,538,308 A | | 9/1985 | Grigoriev | |
| 4,694,515 A | | 9/1987 | Rogers, Jr. | |
| 5,129,113 A | | 7/1992 | Sherman | |
| 5,329,654 A | | 7/1994 | Sherman | |
| 5,566,409 A | * | 10/1996 | Klearman | 5/723 |
| 5,794,283 A | | 8/1998 | Vila et al. | |
| 6,042,186 A | * | 3/2000 | Kojic et al. | 297/452.41 |
| D434,243 S | * | 11/2000 | Casto et al. | D6/381 |
| 6,711,761 B2 | * | 3/2004 | Choi | 5/114 |
| D507,445 S | * | 7/2005 | Song et al. | D6/604 |
| 2003/0200610 A1 | | 10/2003 | Wang | |

FOREIGN PATENT DOCUMENTS

FR 2554335 5/1985

* cited by examiner

*Primary Examiner*—Patricia Engle
*Assistant Examiner*—Fredrick Conley
(74) *Attorney, Agent, or Firm*—Harness, Dickey & Pierce, P.L.C.

(57) ABSTRACT

An inflatable mattress for storage within and use in combination with a furniture member includes a main body portion having a lower surface supportable on a surface such as a floor and an upper surface. An extending end of the mattress includes an extension of the upper surface co-planar with the upper surface, and a support surface which contacts a mating support surface of the furniture member. At least one fluid inlet valve and at least one fluid discharge valve are distributed about the inflatable mattress. A plurality of attachment devices connected to the inflatable mattress are used to temporarily or permanently attach the inflatable mattress to the furniture member. The inflatable mattress is collapsible for storage within a furniture member interior envelope.

26 Claims, 6 Drawing Sheets

INFLATABLE MATTRESS

FIELD OF THE INVENTION

The present invention relates in general to inflatable mattresses and more specifically to a device and method for making an inflatable mattress extendable from a furniture member.

BACKGROUND OF THE INVENTION

Mattresses for "sleep sofas" are commonly thinner versions of standard spring or foam mattresses, which allow the mattress to be folded, along with a complex folding mechanism, for storage within the frame of the sleep sofa. Disadvantages of these mattresses include limited width due to the folding mechanism, limited length due to the amount of mechanism/mattress volume that can be stored, and reduced sleep comfort due to the decreased support of the mattress in addition to user contact with the folding mechanism.

Inflatable mattresses are often used as alternatives to standard box spring or coiled spring mattresses, and in some cases as alternatives to sleep sofas, particularly where portability of the mattress is required. Inflatable mattresses commonly include a fluid valve for inflating and deflating the mattress, which is connectable to a fluid pump such as an air pump. These mattresses are commonly constructed of polymeric material(s) which is lightweight for transfer, and foldable for storage when the mattress is not in use. Disadvantages of a stand alone air mattress include that the air mattress, although portable, requires significant floor space of the dwelling it is used in, independent of the envelope already required for furniture items of the dwelling. Air mattresses are typically folded for storage in a box or container, which requires its own storage volume when not in use. Also, air mattresses are generally not connectable to other structure or furniture items, and therefore can shift when a user is entering onto or exiting from the mattress.

Inflatable mattresses in combination with a conventional box spring or in combination with a mattress support system are known which provide adjustable pressure sleep support zones. These inflatable mattresses are internally divisible into two or more zones, each having an inflation/deflation valve to control the fluid pressure in each zone. A disadvantage of the combination of an inflatable mattress and a mattress support system is this system still requires the cost and complexity of the support system, as well as the volume of the support system even if the air mattress is deflated.

SUMMARY OF THE INVENTION

According to a preferred embodiment of an inflatable mattress system of the present invention, an inflatable mattress for storage within and use in combination with a furniture member includes a main body portion having a lower surface supportable on a surface such as a floor and an upper surface. A mattress extending end includes an extension surface substantially co-planar with the upper surface, and a support surface elevated above the lower surface and operable to contact a mating support surface of the furniture member. At least one fluid inlet valve and at least one fluid discharge valve are distributed about the inflatable mattress. A plurality of attachment devices connected to the inflatable mattress are used to temporarily or permanently attach the inflatable mattress to the furniture member. The inflatable mattress is collapsible for storage within a furniture member interior envelope.

According to another aspect of the present invention, a plurality of straps are internally disposed within the mattress. A first group of the straps are connected to opposing side walls of the mattress. A second group of the straps are connected to opposing end walls of the mattress. A third group of the straps are connected to each of the upper and lower surfaces. The plurality of straps create a predetermined shape of the mattress in an inflated condition.

According to still another aspect of the invention, a plurality of connectors extend outwardly from the mattress. The connectors are operable to either temporarily or permanently connect the mattress to structure of the furniture member. The inflatable mattress when deflated is collapsible for storage within an interior envelope of the furniture member.

According to yet another aspect of the invention, a method for creating an inflatable mattress partially supportable by a furniture member is provided. The method includes connecting an inflatable mattress to a furniture member. The method further includes inflating a main body of the mattress. The method still further includes extending a portion of the mattress over a support portion of the furniture member. The method also includes storing the mattress in a collapsed condition within the furniture member.

An inflatable mattress of the present invention provides several advantages. By securing the inflatable mattress to a furniture member a more stable sleeping surface is provided than for a free standing air mattress. An inflatable mattress extending member of the present invention is supportable by a spring deck of the furniture member and allows the inflatable mattress to be either releasably or fixedly connected to the furniture member. Use of a rotating joint allowing the extending member to reach an extended position over the spring deck permits the entire inflatable mattress to be folded for storage. In one aspect, the folded inflatable mattress is stored within a cavity of the furniture member. A substantially planar surface which includes the extending member is provided when the mattress is inflated. A total length and a total width of the inflatable mattress are not limited by mechanical structure used for common sleep sofa designs.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF PREFERRED EMBODIMENT

The following description of one preferred embodiment is merely exemplary in nature and is in no way intended to limit the invention, its application, or uses.

Figure 1:
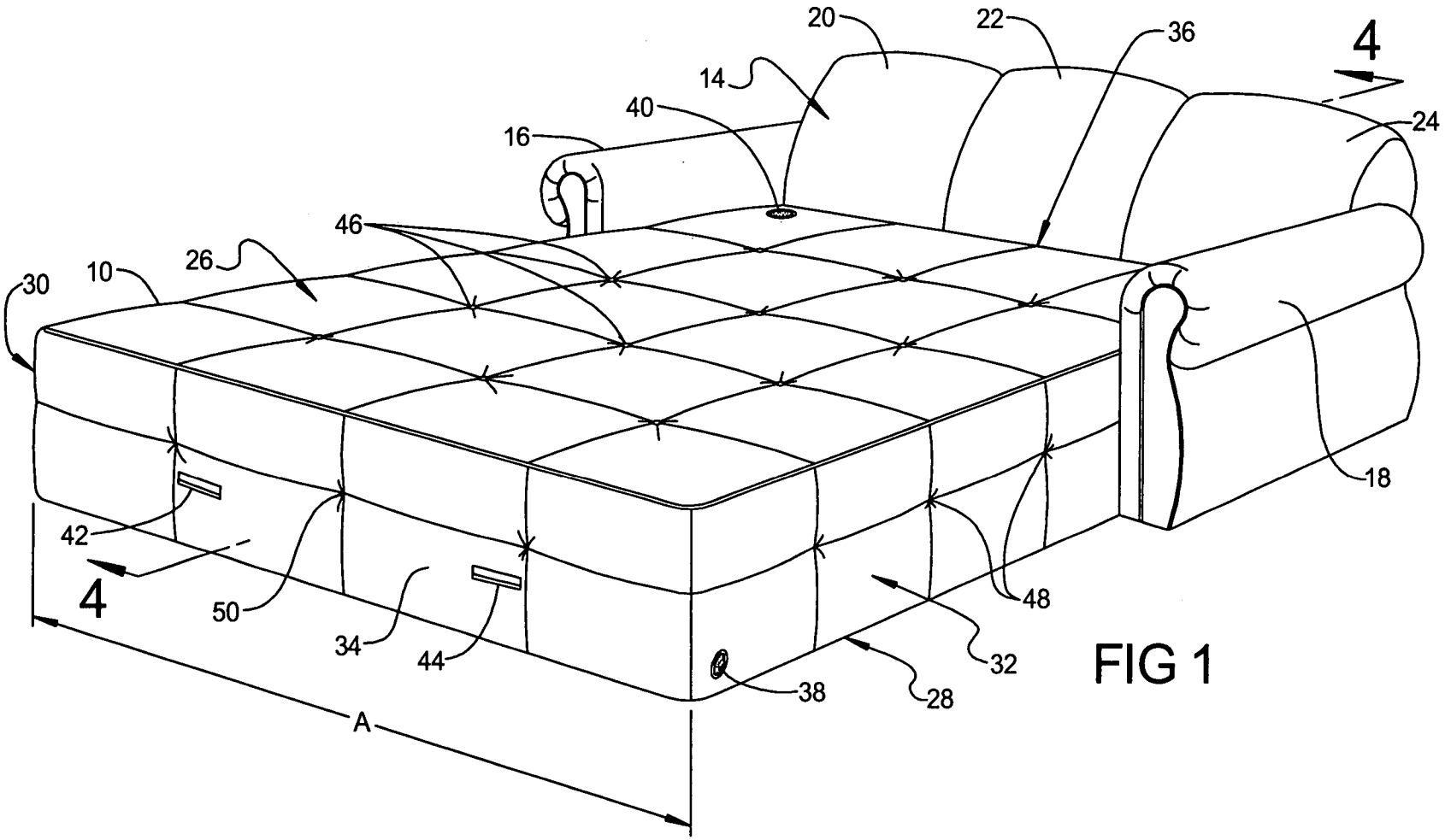
FIG. 1 is a front elevational perspective view of an inflatable mattress of the present invention in an extended condition from a furniture member.

According to a preferred embodiment of the present invention and referring generally to FIG. 1, an inflatable mattress 10 which is configurable into a furniture/mattress assembly 12 by joining to a furniture member 14 is shown in a deployed, fully inflated condition. Furniture member 14 includes a first side member 16, a second side member 18, and first, second and third rear cushions 20, 22, 24. Inflatable mattress 10 has a mattress width "A" and is positionable between and can substantially contact inner sides of both first and second sides 16, 18.

Inflatable mattress 10 further includes a mattress upper surface 26, a mattress lower surface 28, a first mattress side wall 30, a second mattress side wall 32, a mattress distal end wall 34 and a mattress end wall 36. A first valve 38 is positioned preferably on one of the mattress side walls, in this exemplary embodiment being disposed on second mattress side wall 32. A second valve 40 is disposed on mattress upper surface 26. Locations for both first and second valves 38, 40 can vary from those shown at the discretion of the designer. The purpose for first and second valves 38, 40 is to inflate inflatable mattress 10 using an inflation device (not shown) such as an air pump connected to the valve(s) and/or deflate the inflatable mattress. In another aspect, only a single valve is used. One advantage of using two or more valves is that deflation time is decreased. Inflatable mattress 10 can also include a first strap 42 and a second strap 44 used to assist a user in fully extending inflatable mattress 10 to the deployed position shown prior to or during inflation.

Mattress upper surface 26 includes a plurality of upper surface restraint points 46. Similarly, each of first and second mattress side walls 30, 32 include a plurality of side wall restraint points 48 (only side wall 32 is visible in this view). Each of mattress distal end wall 34 and mattress end wall 36 similarly include a plurality of end wall restraint points 50. Restraint points 46, 48, 50 are attachment locations for internal straps which will be described in detail further herein. These internal straps function to control the outer geometry and envelope of inflatable mattress 10. The quantity and location of the plurality of restraint points 46, 48, 50 can vary from that shown depending upon the dimensions or shape of inflatable mattress 10, the relative amount of stiffness or rigidity sought by the designer, and/or the materials selected for inflatable mattress 10. According to one embodiment of the present invention, material for inflatable mattress 10 is selected from a polymeric material.

Figure 2:
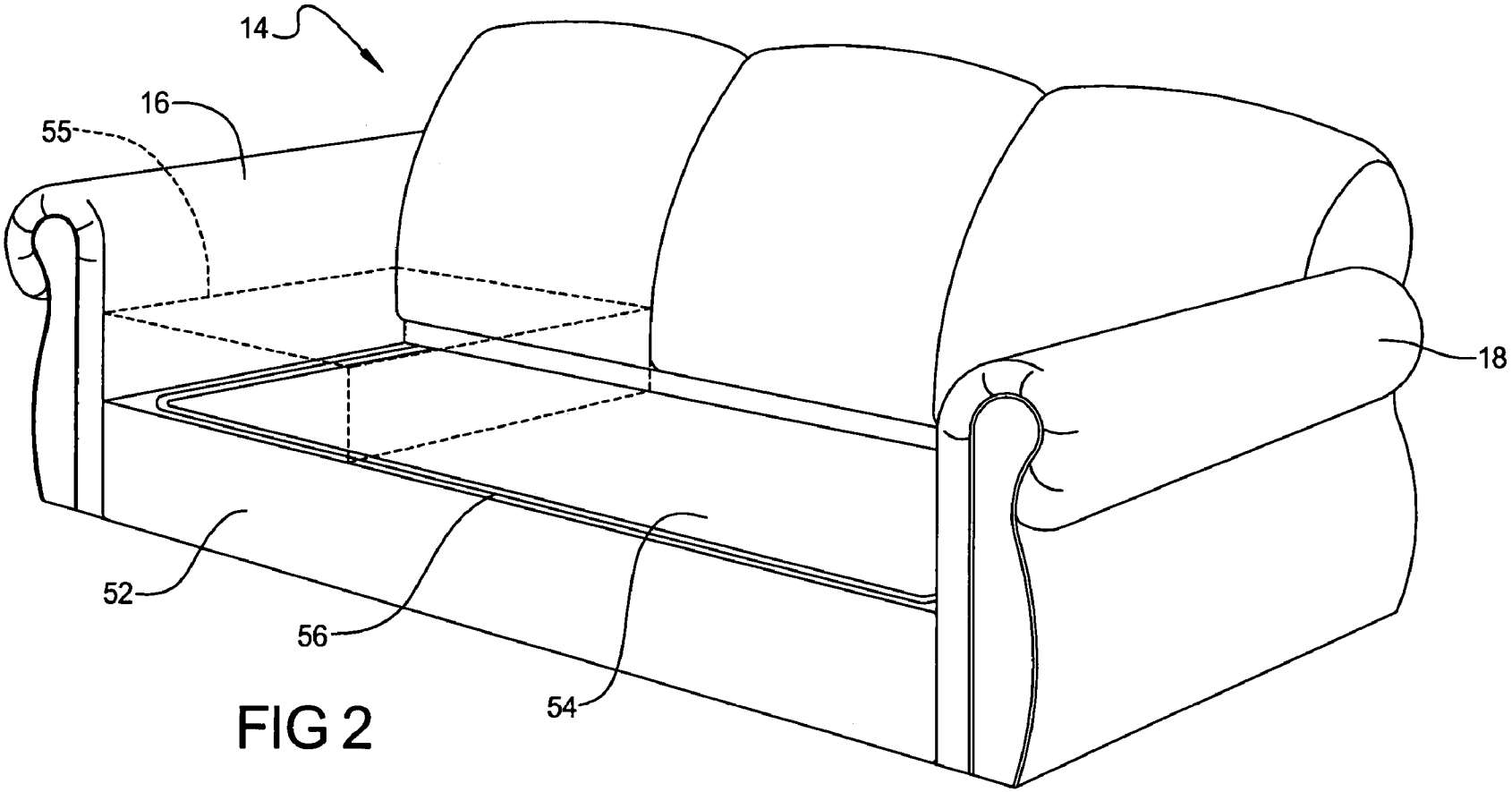
FIG. 2 is a front elevational perspective view of the furniture member prior having the inflatable mattress stored within and prior to extension of the inflatable mattress.

Referring now generally to FIG. 2, furniture member 14 further includes a front face 52 connecting first and second sides 16, 18. A spring deck 54 is positioned in a down or support position substantially level with an upper end of front face 52. A plurality of seat cushions 55 (a first one shown in phantom only) are commonly positioned above and supported by spring deck 54. Seat cushions 55 are removed in order to access spring deck 54 for further access to an inflatable mattress 10 stored below. Spring deck 54 is connected to a deck support frame 56 which is rotatable after seat cushions 55 are removed.

Figure 3:
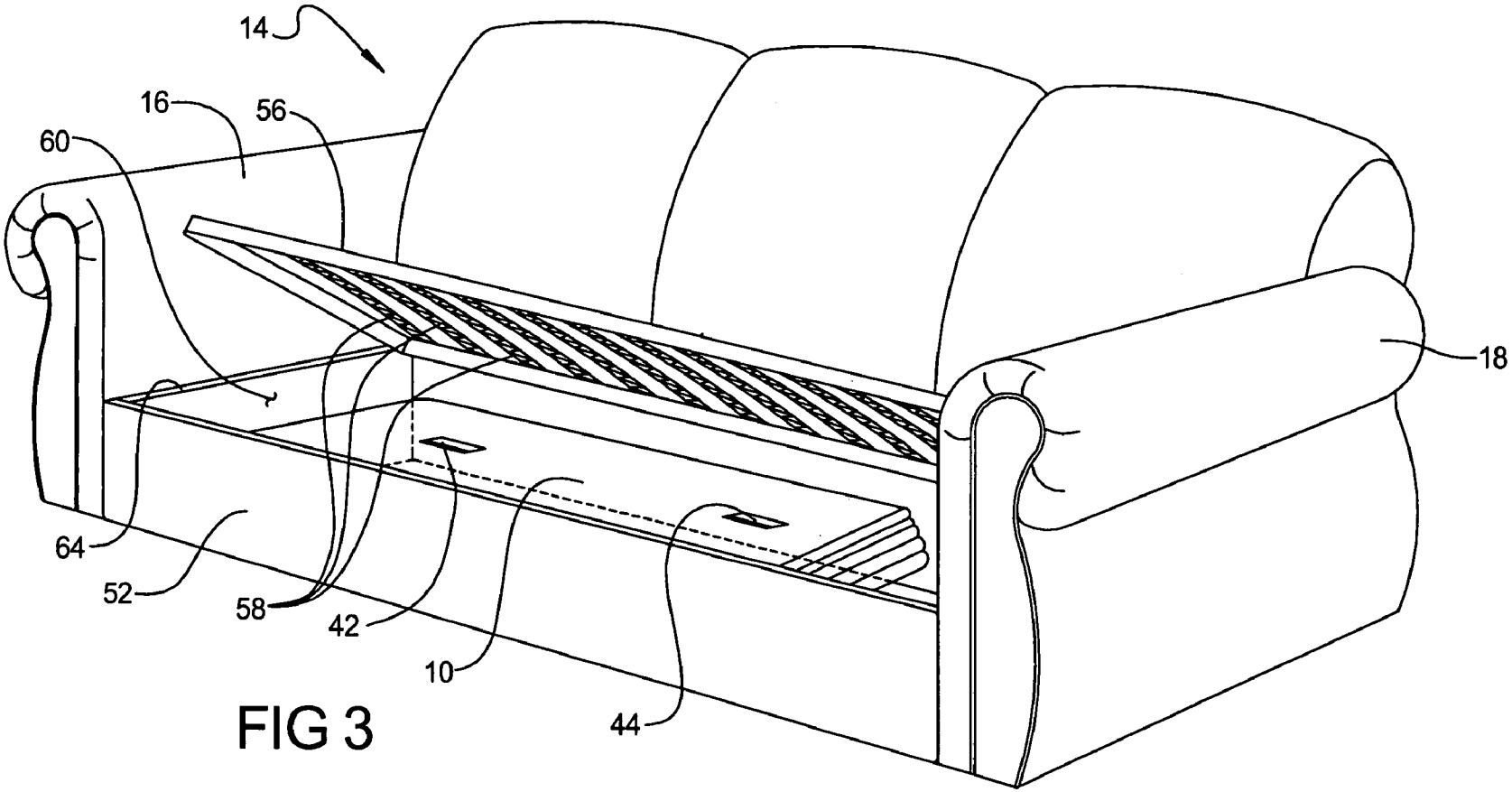
FIG. 3 is the front elevational perspective view of FIG. 2 further showing the spring deck in an open rotated position allowing access to the inflatable mattress stored therein.

Referring next to FIG. 3, after removal of seat cushions 55, deck support frame 56 is rotatable to an open position shown. A plurality of support members 58 commonly including sinuous support springs and/or polymeric or cloth webbing material are connected at opposing ends to deck support frame 56. When deck support frame 56 is rotated to the open position shown, a cavity 60 is accessible. Furniture member 14 further includes a rear frame member 62 and an opposed pair of frame side walls 64 (only one is visible in FIG. 3). Cavity 60 is defined between first and second sides 16, 18 including frame side walls 64, front face 52 and rear frame member 62. Inflatable mattress 10 in a folded, deflated condition can be stored within cavity 60. Additional items such as sheets, pillows, an air pump for inflating inflatable mattress 10, and the like can also be stored in cavity 60. First and second straps 42, 44 are appropriately positioned when inflatable mattress 10 is in the folded, deflated condition to assist in removing inflatable mattress 10 from cavity 60.

Figure 4:
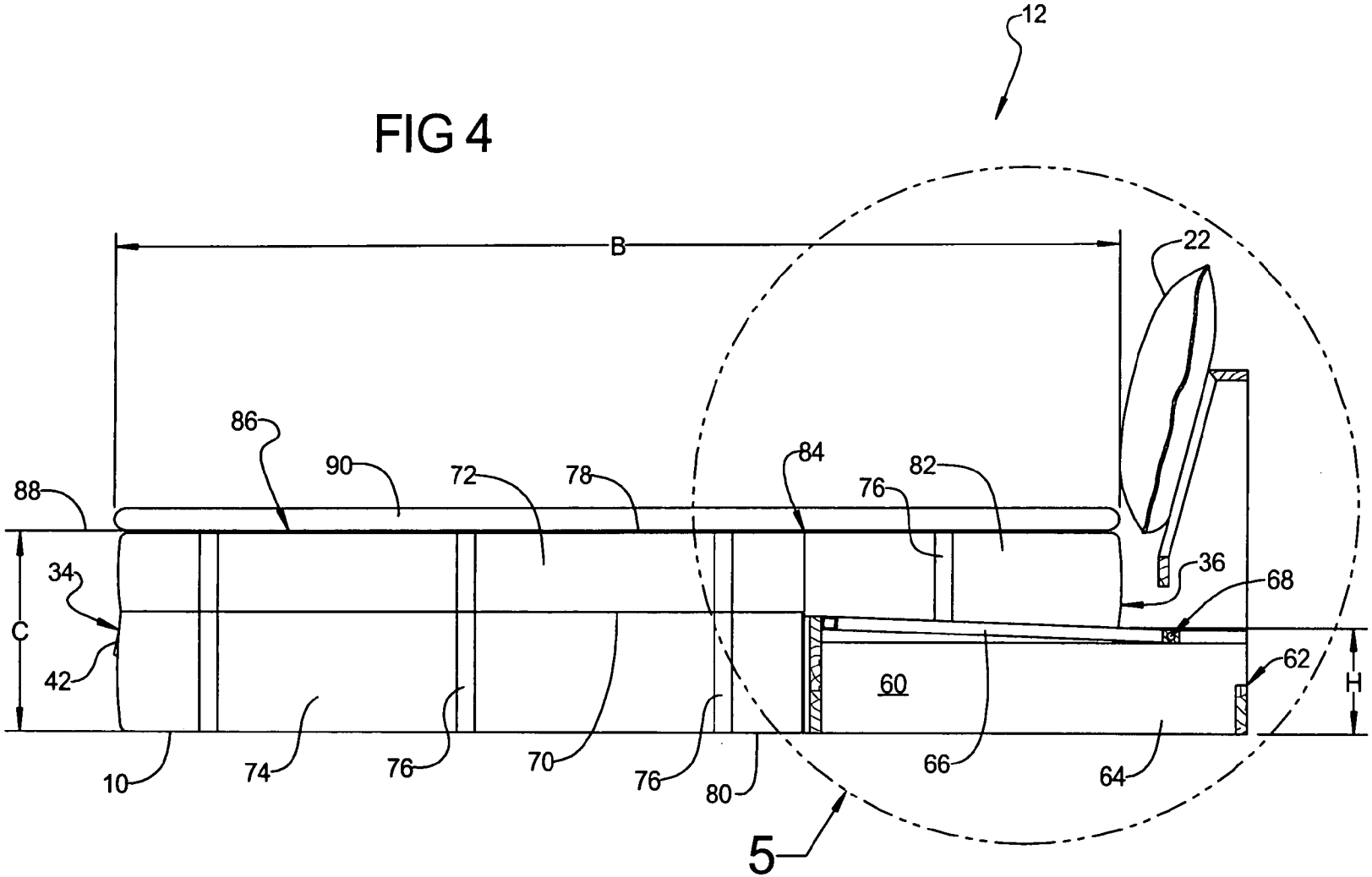
FIG. 4 is a cross sectional side elevation view taken at section 4-4 of FIG. 1.

As best seen in reference to FIG. 4, deck support frame 56 further includes an opposed pair of support frame side members 66. Support frame side members 66 are each rotatably connected to one of the frame side walls 64 and pivotable about a pivot point 68 to permit access to cavity 60. After inflatable mattress 10 is removed from cavity 60, deck support frame 56 including support frame side walls 64 is rotated back to the down position shown in FIG. 4 where deck support frame 56 and support members 58 are operable to support a portion of inflatable mattress 10. In the extended, inflated condition of inflatable mattress 10 shown, a plurality of longitudinal straps 70 which operably define each of the end wall restraint points 50 shown in FIG. 1 functionally divide inflatable mattress 10 into an upper zone 72 and a lower zone 74. In one embodiment, air or fluid within inflatable mattress 10 is freely distributed between upper and lower zones 72, 74. A plurality of depth control straps 76 are each connected at opposing ends to a mattress first inner wall 78 and a mattress second inner wall 80 respectively. Depth control straps 76 define each of the plurality of upper surface restraint points 46 shown in FIG. 1.

Inflatable mattress 10 further includes an extending member 82 which is open to at least upper zone 72 during filling of inflatable mattress 10. Extending member 82 is rotated to the position shown in FIG. 4 about a rotation point 84 prior to filling inflatable mattress 10. A lower surface (as viewed in FIG. 4) of extending member 82 is positioned at a height "H" above a support surface of inflatable mattress 10 and furniture member 14. Extending member 82 therefore functions as a cantilever as inflatable mattress 10 is inflated, and which can be subsequently supported by support members 58 and deck support frame 56.

Because inflatable mattress 10 requires no mechanical structure to join inflatable mattress 10 to furniture member 14, a mattress length "B" can be substantially any length chosen by the designer. Common sleep sofa mattresses are generally limited to a length of approximately 72 inches. Mattress length "B" of inflatable mattress 10 can be increased above 72 inches if desired. When inflated, inflatable mattress 10 defines a substantially planar surface 86 which is co-planar with a horizontal plane 88. A mattress height "C" measurable to plane 88 can also vary at the discretion of the designer. In another aspect of the present invention, a mattress pad 90 is integrally provided with inflatable mattress 10. Mattress pad 90 which is also known as a pillow top is optionally provided for a softer "feel" for inflatable mattress 10 and/or to provide a more durable upper surface. In a further aspect of the present invention, mattress pad 90 is releasably joined to inflatable mattress 10. The total usable mattress length "B" is measurable from mattress end wall 36 to mattress distal end wall 34. Mattress length "B" is limited proximate to mattress end wall 36 by the position of first, second and third rear cushions 20, 22, 24.

Figure 5:
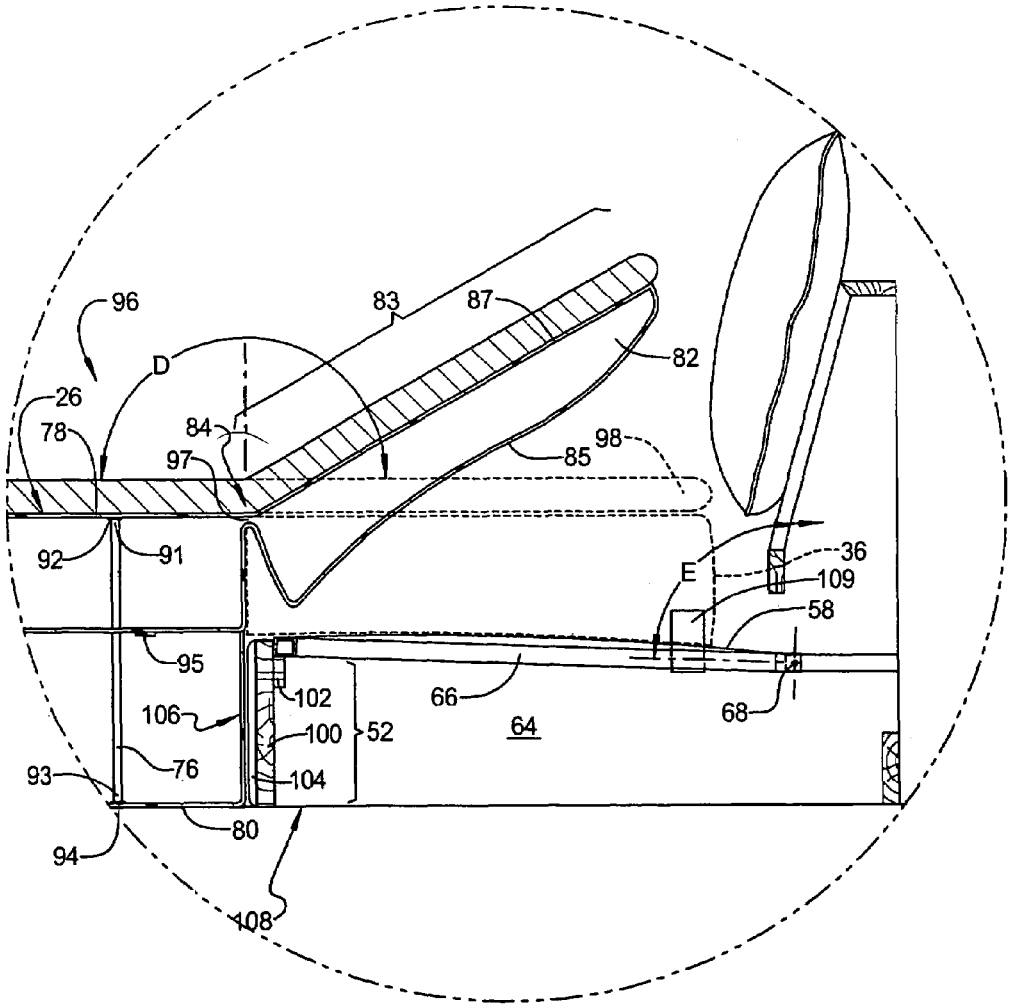
FIG. 5 is an exploded detail view of area 5 of FIG. 4.

Referring generally now to FIG. 5, each of depth control straps 76 are connected to mattress first inner wall 78 and mattress second inner wall 80 at a first end 91 using a connection joint 92 and at a second end 93 using a connection joint 94. Connection joints 92, 94 can be made using multiple techniques, including but not limited to adhesive bonding, heat bonding, sewing, and the like. Connection joints 92, 94 are typical of the connection joints also used to position each of longitudinal straps 70 as well as each of a plurality of width control straps 95. Width control straps 95 define each of the plurality of side wall restraint points 48 shown in reference to FIG. 1.

A main section 96 of inflatable mattress 10 is divisible from extending member 82 at rotation point 84. Extending member 82 includes a cantilevered portion 83 having an elastically inflatable envelope 85. A surface 87 of extending member 82 is alignable with upper surface 26 to operably create planar surface 86. A flow passage 97 is provided proximate to rotation point 84 to allow free air or fluid entrance and exit between inflatable envelope 85 and main section 96. After main section 96 is positioned outwardly of furniture member 14, extending member 82 is rotated about rotation point 84 about an extension member arc of rotation "D" to an extended position 98. In extended position 98, extending member 82 contacts each of the plurality of support members 58. Deck support frame 56 including support frame side walls 64 are rotatable about a frame member arc of rotation "E" at pivot points 68 to allow removal of inflatable mattress 10 from cavity 60 for deployment. Deck support frame 56 is then rotated back about arc of rotation "E" to its normal or down position shown to support extending member 82.

Front face 52 further includes a structural face member 100 and a support rail 102 fixedly connected to structural face member 100. Support rail 102 supports deck support frame 56 in the down or support position. An upholstered pad 104 is also commonly provided on an outward facing side of structural face member 100. A lower mattress end wall 106 of inflatable mattress 10 is positioned to abut upholstered pad 104. Each of furniture member 14 and inflatable mattress 10 are commonly supported at a floor line 108. In another aspect of the invention (not shown) legs or feet can be provided for furniture member 14 which elevate furniture member 14 above floor line 108. Mattress height "C" can be adjusted in this embodiment to include any additional height provided by the legs or feet.

After extending member 82 is rotated about rotation point 84 and positioned as shown in the extended position 98, one or more attachment straps 109 are used to either releasably or fixedly attach extending member 82 to either frame side walls 64 or to support frame side members 66. Attachment straps 109 are attached to inflatable mattress 10 for example by sewing, by adhesive attachment, and/or by heat bonding. Distal ends of attachment straps 109 are connected to frame side walls 64 or support frame side member 66 using a plurality of fasteners, a hook and loop fastener assembly, etc. Fasteners used to connected attachment straps 109 can also include rivets, snaps, zippers and the like. Use of attachment straps 109 prevents extending member 82 and thereby inflatable mattress 10 from displacing from the position shown in FIG. 5 which would leave extending member 82 in an unsupported position. Releasable connections for attachment straps 109 allow some adjustment in the positioning of extending member 82. Releasable connections also allow inflatable mattress 10 to be completely folded and stored within cavity 60 without interference from attachment straps 109. In another embodiment, attachment straps 109 are fixedly connected to frame side walls 64 and/or structural face member 100 and releasably connectable to extending member 82. In still another embodiment, attachment straps 109 can also connect lower mattress end wall 106 to upholstered pad 104 and/or structural face member 100.

Figure 6:
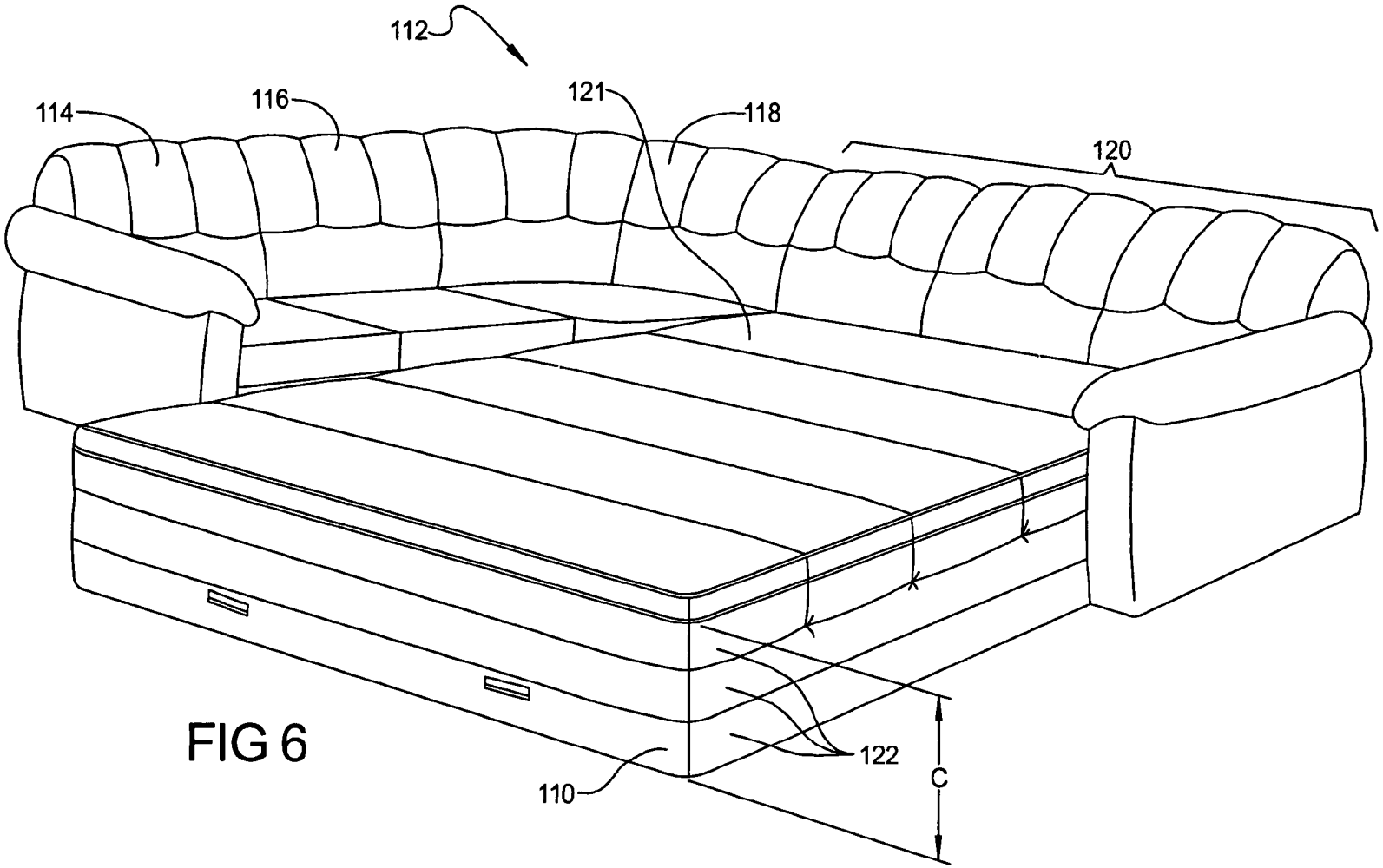
FIG. 6 is a front elevational perspective view similar to FIG. 1 showing another embodiment of an inflatable mattress of the present invention.

As best seen in reference to FIG. 6, in another embodiment an inflatable mattress 110 is extendable from a sectional furniture/mattress assembly 112. Sectional furniture/mattress assembly 112 includes an end sectional member 114, a middle sectional member 116, and a corner sectional member 118. Inflatable mattress 110 is connectable to and extends from a sofa sectional member 120. An extending member 121 of inflatable mattress 110 is supported by and connected to sofa sectional member 120. A plurality of mattress zones 122 are used for inflatable mattress 110. The quantity of mattress zones 122 is discretionary depending at least upon the mattress height "C". By changing dimensions, smaller versions (not shown) of inflatable mattress 110 can also be deployed from and/or individually connected to end sectional member 114, middle sectional member 116, or corner sectional member 118.

An inflatable mattress of the present invention provides several advantages. By securing the inflatable mattress to a furniture member a more stable sleeping surface is provided than for a free standing air mattress. An inflatable mattress extending member of the present invention is supportable by a spring deck or a similar surface of the furniture member and allows the inflatable mattress to be either releasably or fixedly connected to the furniture member. Use of a rotating joint allowing the extending member to reach an extended position over the spring deck permits the entire inflatable mattress to be folded for storage. In one aspect, the folded inflatable mattress is stored within a cavity of the furniture member. A substantially planar surface is created by the extending member and the upper surface of a mattress main section when the mattress is inflated. A total length and a total width of the inflatable mattress are not limited by mechanical structure used for common sleep sofa designs. Multiple geometric designs and multiple sizes of the inflatable mattress of the present invention can be used.

The description of the invention is merely exemplary in nature and, thus, variations that do not depart from the gist of the invention are intended to be within the scope of the invention. For example, the floor surface which supports the inflatable mattress of the present invention can be any substantially flat, substantially horizontal surface including but not limited to residential floors, basement floors, concrete pads, floors of mobile vehicles such as motor homes, and substantially flat ground surfaces. The extending member of the inflatable mattress can also be supported by a plurality of furniture members including but not limited to a seating surface of a chair, a love-seat, a bench, a captain's seat, or a table. The inflatable mattress of the present invention is not limited in geometric design. Multiple geometric designs, each in multiple sizes can be used, including rectangular, square, oval, round, heart-shaped, and the like. The inflatable mattress of the present invention is also not limited to the use of air as the internal fluid. Other fluids, including other gases and water can also be used. Such variations are not to be regarded as a departure from the spirit and scope of the invention.

What is claimed is:

1. An inflatable mattress adaptable for use with a furniture member and supportable from a floor surface, the inflatable mattress comprising:

a main section having an upper surface, opposing end walls, and a lower surface operable to contact the floor surface in an inflated condition of the inflatable mattress; and a mattress extending member having an inflatable portion and a non-inflatable portion both rotatable prior to co-inflation of the inflatable portion with the main section substantially horizontally from one of the end walls, the extending member defining a cantilevered portion of the inflatable mattress freely suspended above the floor surface in the inflated condition, the mattress extending member having an extending member lower surface positioned at a height above the main section lower surface in the inflated condition.

2. The inflatable mattress of claim 1, further comprising at least one strap having opposed ends each connectably joined to one of the opposing end walls.

3. The inflatable mattress of claim 2, wherein the main section is internally divisible into a plurality of zones by the plurality of straps.

4. The inflatable mattress of claim 2, further comprising:

a connection joint operable to connectably join each of the opposed ends of the at least one strap to the one of the opposing walls; and a restraint point operably created at each connection joint.

5. The inflatable mattress of claim 4, wherein the connection joint comprises a heat bondable joint.

6. The inflatable mattress of claim 4, wherein the connection joint comprises an adhesive joint.

7. The inflatable mattress of claim 1, further comprising a first valve connectable to the extending member and operable to at least one of inflate and deflate the inflatable mattress.

8. The inflatable mattress of claim 7, further comprising a second valve connectable to the main member and operable to at least one of inflate and deflate the inflatable mattress.

9. The inflatable mattress of claim 1, further comprising a flow passage fluidly connecting the extending member to the main section operable to allow free flow of fluid between the extending member and the main section.

10. The inflatable mattress of claim 1, wherein a surface of the mattress extending member and the upper surface operably create a substantially co-planar surface in the inflated condition.

11. An inflatable mattress positionable at least partially over a furniture member and supportable from a floor surface, the inflatable mattress comprising:

a main section having an upper surface, opposing end walls, and a lower surface operable to contact the floor surface in an inflated condition of the inflatable mattress;

a mattress extending member extending substantially horizontally from one of the end walls defining a cantilevered portion of the inflatable mattress freely suspended above the floor surface in the inflated condition, the mattress extending member having an extending member lower surface positioned at a height above the main section lower surface and positionable at least partially over the furniture member in the inflated condition; and a mattress pad connectable to both the main section and the mattress extending member, the mattress pad being rotatable with the mattress extending member.

12. An inflatable mattress positionable at least partially over a furniture member and supportable from a floor surface, the inflatable mattress comprising:

a main section having an upper surface, opposing end walls, and a lower surface operable to contact the floor surface in an inflated condition of the inflatable mattress;

a mattress extending member extending substantially horizontally from one of the end walls defining a cantilevered portion of the inflatable mattress freely suspended above the floor surface in the inflated condition, the mattress extending member having an extending member lower surface positioned at a height above the main section lower surface and positionable at least partially over the furniture member in the inflated condition; and at least one attachment strap connected to the extending member and operable to connectably join the extending member to the furniture member.

13. The inflatable mattress of claim 12, wherein the attachment strap is connectable to the extending member using a releasable joint.

14. An inflatable mattress system adapted for connecting to a support surface of a furniture member, the system comprising:

a mattress main section having an upper surface, opposing end walls, and a lower surface operable to contact a floor surface in an inflated condition of the inflatable mattress;

a mattress extending member rotatably connectable to one of the end walls at a rotation point, the rotation point permitting the mattress extending member to extend from the main section as a cantilevered portion of the inflatable mattress when the inflatable mattress is inflated, the mattress extending member being freely positioned above the floor surface in the inflated condition with the main section in contact with and supported by the floor surface;

a surface of the mattress extending member and the upper surface being alignable to create a substantially co-planar surface in the inflated condition; and a furniture member having a support surface adapted to support the mattress extending member, the mattress extending member extendable at least partially over the support surface of the furniture member in the inflated condition;

wherein the mattress extending member is releasably engageable with the support surface of the furniture member.

15. The system of claim 14, further comprising a cavity operably created in the furniture member, the cavity operable to receive the main mattress section and the mattress extending member in a mattress deflated condition.

16. The system of claim 14, further comprising a mattress pad connectable to both the main mattress section and the mattress extending member, the mattress pad being deflectable upon rotation of the mattress extending member.

17. The system of claim 14, further comprising at least one attachment strap connected to the extending member and operable to connectably join the extending member to the furniture member.

18. The system of claim 14, further comprising a first valve connectable to one of the surface of the mattress extending member and the upper surface and operable to at least one of inflate and deflate the inflatable mattress.

19. The system of claim 14, further comprising:

a first valve connectable to the extending member and operable to at least one of inflate and deflate the inflatable mattress; and a second valve connectable to one of the opposing end walls and operable to deflate the inflatable mattress.

20. The system of claim 14, further comprising a flow passage fluidly connecting the extending member to the main section operable to allow free flow of fluid between the extending member and the main section.

21. The system of claim 14, wherein the extending member further comprises an elastically inflatable envelope.

22. A method for creating an inflatable mattress, the inflatable mattress including: a main section having opposing end walls; and an extending member having a surface, the method comprising:

rotatably joining the mattress extending member to one of the opposing end walls of the main section at a rotation point;

co-inflating both the main section and the extending member with the main section in contact with a ground surface wherein the extending member defines a cantilevered portion rotatable about the rotation point;

rotating the mattress extending member to an extended position as the main section and the extending member inflate until the surface of the extending member aligns with an upper surface of the main section to operably create a planar surface and wherein a lower surface of the extending member is positioned entirely above the floor surface when the main section is inflated.

23. The method of claim 22, further comprising fluidly connecting the extending member to the main section to allow free flow of fluid between the extending member and the main section.

24. The method of claim 22, further comprising positioning a fluid inlet valve on the extending member.

25. The method of claim 22, further comprising positioning a fluid exhaust valve on one of the opposing end walls.

26. The method of claim 22, further comprising connecting attachment straps to the extending member operable to releasably restrain the extending member.

* * * * *